United States Patent [19]

Yendo

[11] Patent Number: 4,794,747

[45] Date of Patent: Jan. 3, 1989

[54] MULTI-STORIED MULTIPLE-UNIT DWELLING

[76] Inventor: Masayoshi Yendo, 5-6 Ginza 8-chome, Chuo-ku, Tokyo, Japan

[21] Appl. No.: 84,373

[22] Filed: Aug. 11, 1987

[51] Int. Cl.[4] ..... E04H 1/00; E04H 1/04

[52] U.S. Cl. ..... 52/236.3; 52/30

[58] Field of Search ..... 52/236.3, 236.1, 236.6, 52/235, 30; 187/1 R

[56] References Cited

U.S. PATENT DOCUMENTS

| | | | |
|---|---|---|---|
| 1,268,439 | 6/1918 | Dodge | 52/235 |
| 3,552,075 | 1/1971 | Crump | 52/236.3 |
| 4,645,037 | 2/1987 | Gomez | 52/30 |

FOREIGN PATENT DOCUMENTS

| | | |
|---|---|---|
| 50-60023 | 5/1975 | Japan . |
| 51-34662 | 9/1976 | Japan . |
| 52-24342 | 6/1977 | Japan . |
| 57-158471 | 9/1982 | Japan . |
| 57-158472 | 9/1982 | Japan . |
| 179967 | 8/1986 | Japan . |

*Primary Examiner*—James L. Ridgill, Jr.

*Attorney, Agent, or Firm*—Brumbaugh, Graves, Donohue & Raymond

[57] ABSTRACT

A multi-storied multiple-unit dwelling comprises at least three floors, at least four dwelling units on each floor, each of which is bounded by portions of both of the longer external walls of the dwelling for exposure by openings to light and air, and a stairway-hallway unit within each dwelling unit bounded by walls extending lengthwise of the building and located in spaced-apart relation to the longer external walls to define living spaces in each dwelling unit between the corresponding stairway-hallway unit and the longer external walls. Each stairway-hallway unit has a lower landing on one floor and an upper landing on the next upper floor joined by a stairway. The bounding walls of each stairway-hallway unit have openings providing a passageway below the upper landing linking the living spaces of the corresponding dwelling unit.

12 Claims, 12 Drawing Sheets

ODD FLOOR PLAN

EVEN FLOOR PLAN

DESIGN CONCEPT

DESIGN CONCEPT

DESIGN CONCEPT

ODD FLOOR PLAN

EVEN FLOOR PLAN

MULTI-STORIED MULTIPLE-UNIT DWELLING

BACKGROUND OF THE INVENTION

A common type of layout for large multi-storied, multiple-unit dwellings (e.g., apartment houses}with internal corridors provides access to the dwelling units through corridors on each floor running off elevator and stair shafts. The corridors usually run along the center of the building lengthwise for access to side-by-side units on either side of the corridor. In this basic, widely used design all of the units, except for those at the ends of the building, have only one bounding wall available for openings for light and air. There are, of course, alternative forms of design to increase the number of units with two or more exterior aspects, such as direct access and hall access from more numerous elevators and stairways, but the alternatives involve increased costs per unit because of the greater burden of common space for elevators, stairways and hallways.

Another disadvantage of internal corridor access dwellings is a lack of privacy. With many units sharing a common corridor for access on each floor, the number of encounters with others in coming and going is greater, and such encounters are not always pleasant. Also, noise carrying along the corridors can be very bothersome to the occupants.

SUMMARY OF THE INVENTION

One object of the invention is to provide every dwelling unit of a multi-storied, multiple-unit dwelling with at least two exterior aspects for openings for light and air. A further object is to maintain a low burden of common space on per unit costs. Still another object is to provide a building structure that is inexpensive to construct but has great strength and rigidity, thus making i especially advantageous for use in places where strong earthquakes are probable.

According to the present invention, a multi-storied multiple-unit dwelling comprises at least three floors, at least four dwelling units on each floor, each of which is exposed to light and air by openings on both of the longer external walls of the dwelling, and a stairway-hallway unit within each dwelling unit bounded by a pair of walls extending lengthwise along generally the center of the building and located in spaced-apart relation to the longer external walls to define living spaces in each dwelling unit between the corresponding stairway-hallway unit walls and the longer dwelling external walls. Each stairway-hallway unit has a lower landing on one floor and an upper landing on the next upper floor joined by a stairway. The walls of each stairway-hallway unit have openings providing a passageway below the upper landing linking the living spaces of the corresponding dwelling unit.

In preferred embodiments of the invention, the dwelling units are arranged in vertical sections. Each section is bounded by portions of the longer external walls and by section-bounding walls transverse to and extending between the longer external walls, and there is at least one dwelling unit on each floor of each section. The section-bounding walls of each section are vertically aligned and load-bearing, and the respective bounding walls of all stairway-hallway units in each section are aligned vertically and are load-bearing.

In one embodiment the end sections have only one dwelling unit on each floor, and there is at least one intermediate section between the end sections having two dwelling units on each floor separate by a common wall. The section-bounding walls of all sections are spaced apart to define shaftways for elevators and through stairways, and either the upper or lower landings of all stairway-hallway units of all sections are adjacent to and accessible from an elevator hall.

In another embodiment there are on each floor of each section at least two adjacent units separated by a common wall, the outermost units of each section being bounded by a section-bounding wall. The stairway-hallway units are arranged in each section in vertically staggered relation with the upper landing of a stairway-hallway unit on every other floor joined on that floor to the lower landing of another stairway-hallway unit to form a hallway between adjacent units of the section. In such an embodiment, the respective bounding walls of all stairway-hallway units in the dwelling are preferably aligned vertically and horizontally and are load-bearing. Also preferably, the section-bounding walls and common walls on all floors of each section are vertically aligned and load-bearing.

The adjacent sections of the dwelling may be spaced-apart such that the section-bounding walls of the adjacent sections define shaftways for through stairways and elevators. Alternatively, adjacent sections of the dwelling may abut each other along a common section-bounding wall, and a through stairway may be provided by the stairway-hallway units serving the dwelling units of one section bounded by the common section-bounding walls and by additional stairways joining the upper landings of each such stairway-hallway unit to the lower landings of the stairway-hallway unit next above them.

Further, there is provided, according to the invention, a multi-storied multiple-unit dwelling having at least three floors and dwelling units arranged in at least two vertical sections bounded by section-bounding walls transverse to and extending between the opposite longer external walls. Each section has on each floor at least two adjacent dwelling units bounded by a common wall and by portions of the opposite longer external walls for exposure to light and air, and each section has a pair of spaced-apart walls transverse to the section-bounding walls, spaced apart from the longer external walls and defining stairway-hallways that commence at every other floor of the section with a lower landing providing access to the dwelling unit adjacent one section-bounding wall and ascend by two flights of stairs to the next two floors with a intermediate lading for access to two units on the floor above the lower landing and an upper landing for access to a unit on the second floor above the lower landing. Each dwelling unit below one accessed from a stairway landing has a passageway afforded by openings in the walls defining the stairway-hallways.

In an example based on the invention of the preceding paragraph there are at least three sections, including an intermediate section that has three dwelling units on each floor and two end sections that have two dwelling units on each floor. The sections are spaced apart from each other to define shaftways, and elevators and through stairs are located in the shaftways between the sections. The stairway-hallways of the intermediate section ascend from a lower landing on every other floor adjacent one section-bounding wall by three flights of stairs to an upper landing adjacent the other section-bounding walls with intermediate landings on the second and third floors above the floor of the lower landing for access to two adjacent dwelling units. In this example, the adjacent dwelling units of each section are preferably bounded by straight common dividing walls extending transversely between the longer opposite external walls, the common walls are vertically aligned, and the common walls, section-bounding walls and the walls defining the stairway-hallways are load-bearing.

In its broadest aspect, the invention is a dwelling in which there is access to each dwelling unit from a passage that, instead of running horizontally along a floor, runs from floor to floor on a stairway. Instead of corridors that prevent providing all units with at least two exterior aspects for light and air by blocking passage between opposite external walls, the stairway-hallways enable each unit to have exterior aspects on opposite external walls by allowing passageways between sections of each dwelling unit between the stairway-hallways and the respective opposite external walls provided by openings in the stairway-hallway walls adjacent a part of the unit that is below a stair landing on the floor above.

Each of the stairway-hallways of each section of the dwelling serves a relatively small number of units, as compared with the conventional corridors of many dwellings of equivalent size. There is, accordingly, greater privacy. Furthermore, people in one part of a stairway-hallway are less likely to observe people in another part, because they are separated vertically by the heights of two or even three stories. Noise does not carry as far through the stairway-hallways, particularly from one section to another, as it does in horizontal corridors.

A dwelling embodying the present invention is especially well-suited for construction with load-bearing walls, particularly of reinforced concrete, and without columns or beams. In preferred applications of the architectural principles of the invention the stairway-hallways of each section are defined by walls that extend the full height and width of the section, preferably but not essentially equidistant from the major vertical center plane of the structure. The entry door and passageway openings are staggered floor-to-floor, thus maintaining strong horizontal structural bridging by a story-high solid bearing wall above each opening. The section-bounding walls and common walls between units are also largely uninterrupted. Openings for access between the elevator and through-stairway sections and the stairway-hallways and for landings between successive flights of stairs in many, though not all, embodiments occur on every other floor, leaving a full story-high wall section above each such opening for load bearing. Each section of the building, therefore, comprises a vertical structure consisting of the two strong lengthwise hallway-stairway walls, the widthwise common walls between the units and the widthwise section-bounding walls, all united in a grid (in plan) and linked in each story by the floor.

For a better understanding of the invention, reference may be made to the following description of exemplary embodiments, taken in conjunction with the accompanying drawings.

DESCRIPTION OF THE EMBODIMENTS

Figure 1:
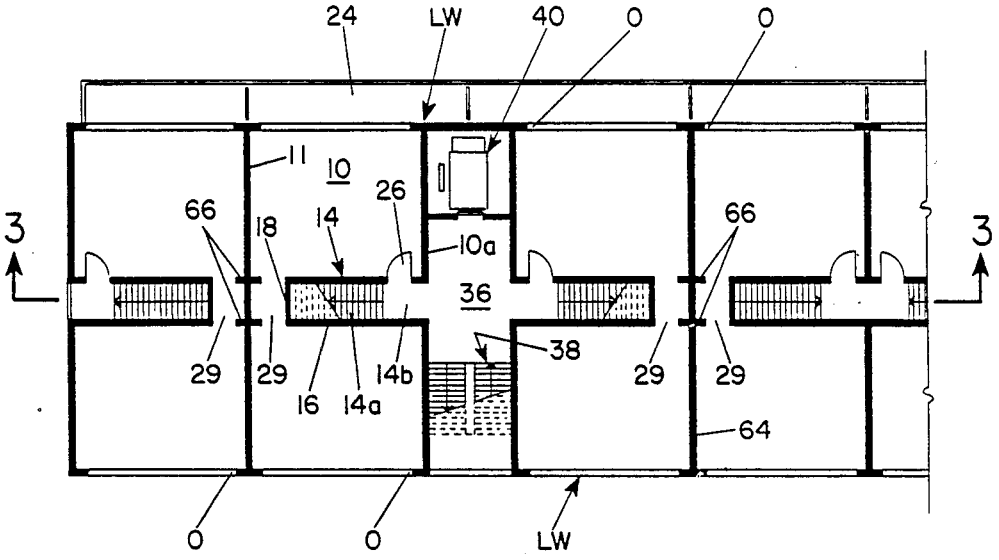
FIG. 1 is a schematic plan view of one of two floor layouts of a first embodiment, which layout is used on every other floor.
Figure 2:
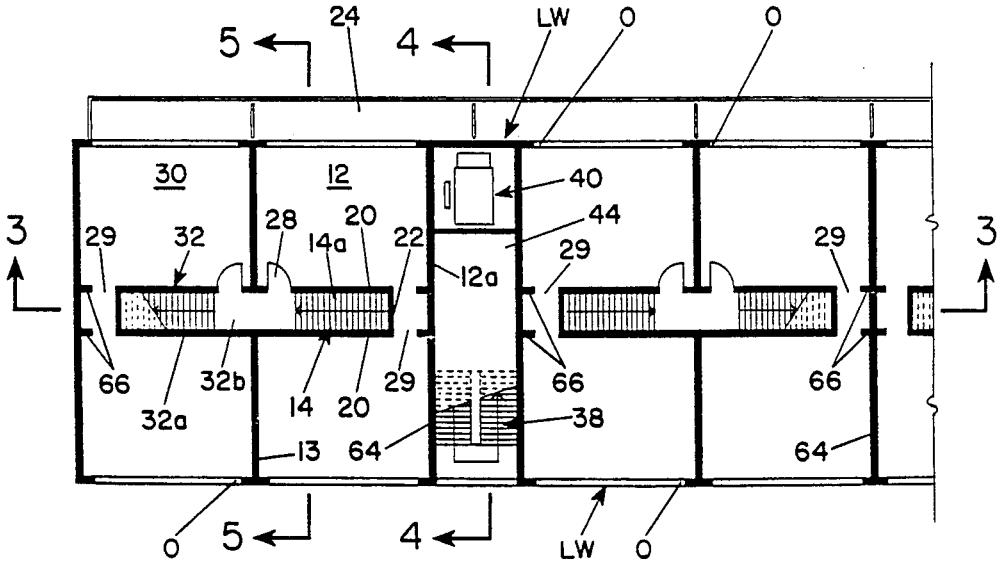
FIG. 2 is a schematic plan view of the other floor layout of the first embodiment, which is used on the floors between those based on FIG. 1.
Figure 3:
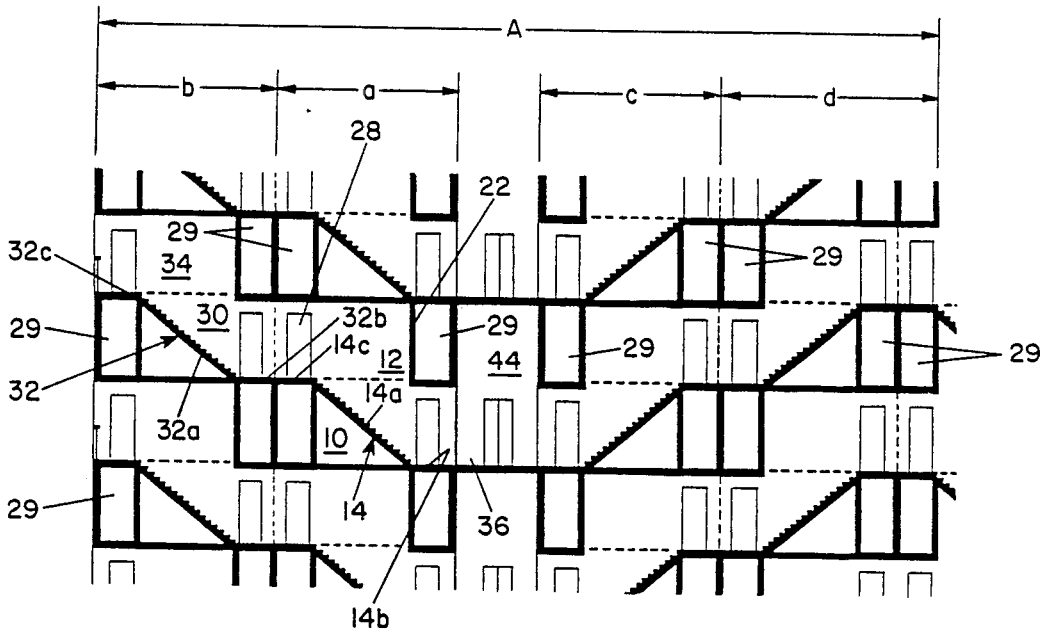
FIG. 3 is a schematic cross-sectional view of parts of four representative adjacent floors of a building according to the first embodiment, the section being along the plane indicated by the line 3—3 in FIGS. 1 and 2.
Figure 4:
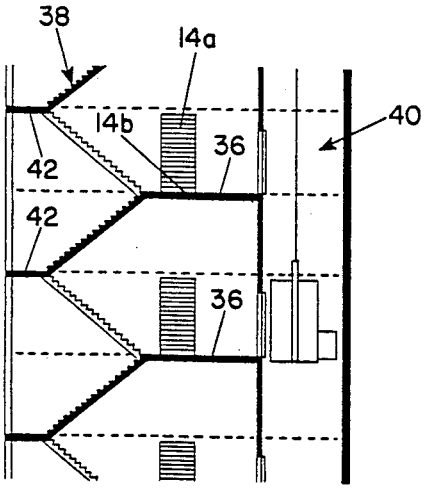
FIGS. 4 and 5 are schematic cross-sectional views of the first embodiment taken along the planes indicated by the lines 4—4 and 5—5 in FIG. 2.
Figure 5:
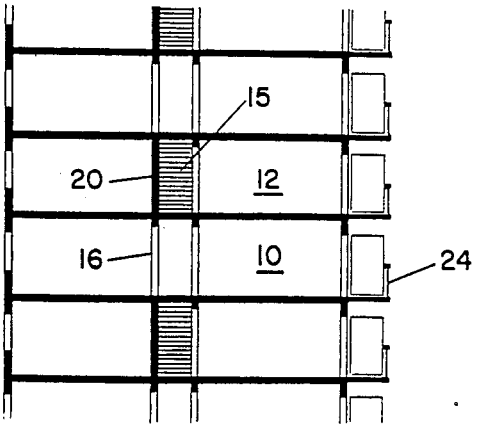
Figure 6:
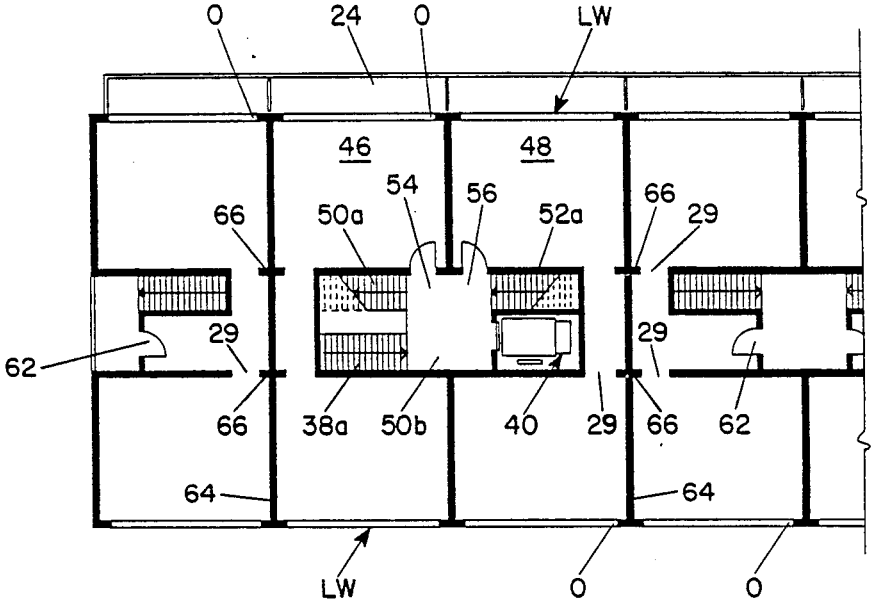
FIG. 6 is a schematic plan view of a portion of every other floor of a second embodiment.
Figure 7:
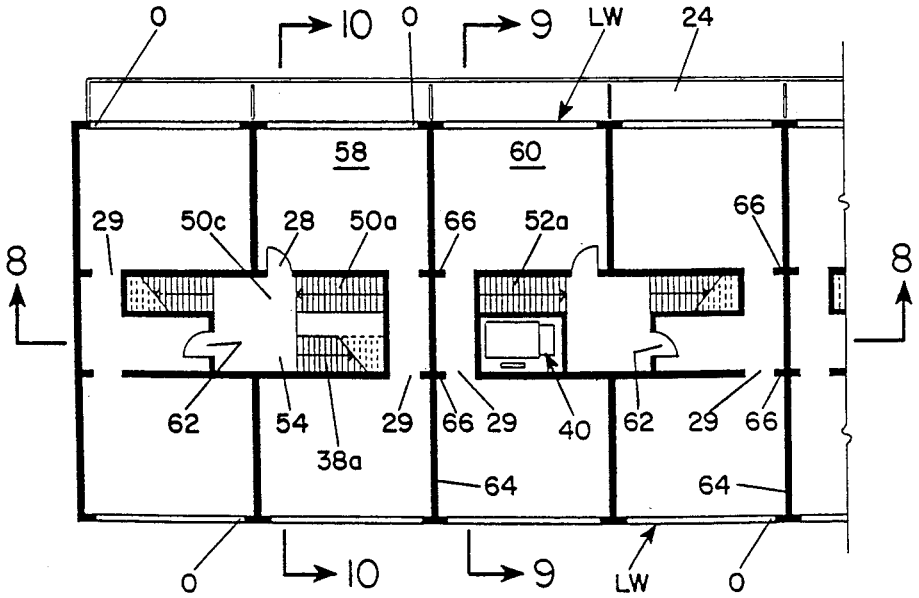
FIG. 7 is a schematic plan view of a portion of the remaining floors of the second embodiment.
Figure 8:
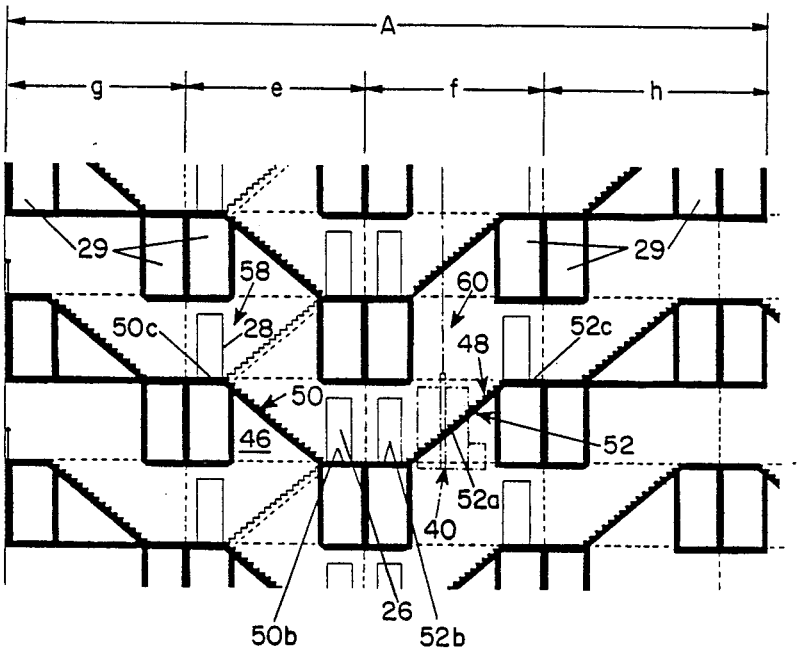
FIGS. 8, 9 and 10 are schematic cross-sectional views of the second embodiment taken along planes represented by the correspondingly numbered lines in FIG. 7.
Figure 9:
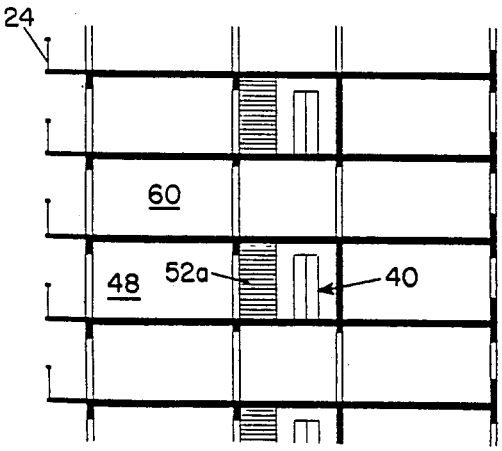
Figure 10:
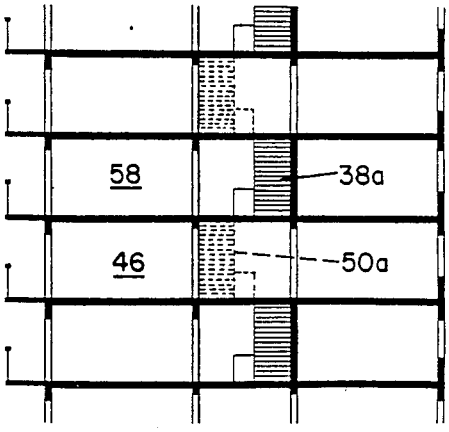

In the first embodiment (FIGS. 1 to 5) the building is composed of any suitable, desired number of stories, which will usually but not always be in the range of 7 to 14. The floor layouts of FIGS. 1 and 2 are repeated alternately running up the building floor to floor. As indicated by the broken lines in FIGS. 1 to 3, the set A of four dwelling units a, b, c, and d may be repeated by locating an additional set or sets laterally adjacent the one shown.

The layout of FIG. 1 is used on the odd-numbered floors, beginning with the ground floor (or the lowermost dwelling floor in case the building has lower floors that are designed for other uses). A dwelling unit 10 is defined by a common wall 11 with another unit and a section-bounding wall 10*a*. In this regard, the set A of dwelling units comprises two sections, one on either side of a shaftway containing an elevator 40 and through stairs 38. The vertically stacked dwelling units a and b form one section and the stacked units c and d a second section.

The units of each section of the building are accessed by stairway-hallway units. One unit 14 begins on an odd-numbered floor (FIG. 1) adjacent a lobby area 36 served by the elevator 40 and leads to an upper landing 14c the next floor by a stairway 14a. The landing 14c is contiguous with the lower landing 32b on the next floor of a second stairway-hallway unit 32 (FIG. 2). A stairway 32a leads up to the next floor to an upper landing 32c (see FIG. 3). The stairway-hallway unit 14 is bounded by walls 16 and 18 extending full height in the story of dwelling unit 10 (FIG. 1) and full height walls 20 and 22 in the unit 12 (FIG. 2) above the unit 10. All stairway-hallway units of the building are similarly walled, thereby establishing a pair of stairway-hallway bounding walls running the full height and full length of the building bridged at intervals by transverse walls (e.g., 18 and 22).

In FIGS. 1 and 2 the entrance to each unit is indicated by the conventional arc and line; each entrance is provided by an opening through a stairway-hallway wall, such as opening 26 to unit 10 and opening 28 to unit 12. Passageways formed by openings 29 in the bounding walls of the stairway-hallways provide access between the living sections of each dwelling unit on either side of the stairway-hallway unit. In all cases, the passageways for each dwelling unit are located under the upper landing of the stairway-hallway unit that lies within (and partially divides) that dwelling unit.

Within each vertical stack of dwelling units, there is a basic module consisting of two vertically adjacent units, for example, dwelling units 10 and 12 in stack (a) joined by the stairway-hallway unit 14 and dwelling units 30 and 34 in stack (b) joined by the stairway-hallway unit 32. This basic module is the building block of the whole building, except that the layouts in the units of stacks c and d are the mirror images of those of stacks a and b. Furthermore, the modules in the stacks b and d remote from the elevator shaft are offset one story higher than those of stacks a and b.

The elevator 40 serves every other floor (the odd numbered floors at the lower landings 14b of the stairway-hallway units 14) and opens onto the lobby area 36. The zones 44 at the even-numbered floors are walled off and part of an open two-story-high space above the lobby area 36. The through stairs 38 meet at landings at each lobby area and landings 42 on the levels of the even-numbered floors between the lobby areas.

It is by far preferable, especially in buildings with a large number of stories, for at least two pairs of building sections a–b and c–d (i.e., two of the sets A) to be combined so that occupants of the upper stories can use the second elevator when the elevator nearest them is out of service. The stairway-hallway units are joined end-to-end (see FIG. 3) and provide stairway-hallway passageways 15 extending the full length of the building.

The units on the odd-numbered floors of stacks b and d (¼ the total number) are reached only by climbing two flights of stairs, which is a disadvantage. The disadvantage is offset by the availability of light and air on three walls of these units. One-quarter of the units (two on each odd-numbered floor) are reached without climbing stairs. The remaining units (one-half of the total) are up one flight of stairs, (all units on even-numbered floors).

All dwelling units (e.g. 10 and 12) are exposed to light and air by openings O, which of course are closable by windows or, when there are balconies 24, doors or combinations of windows and doors, on both of the longer external walls LW of the dwelling. The letter designations "O" and "LW" are applied appropriately in several figures of the drawings to indicate the openings and longer external walls, respectively. In the plan views double lines without shading or hatching represent windows and/or doors, as is conventional in architectural drawings.

The embodiment of FIGS. 6 to 10 is the same in most respects as the embodiment of FIGS. 1 to 5. The main differences are that the stairway-hallways are wider and the through stairs 38 and elevators 40 are located between the stairway-hallway walls. A basic module comprises a lower dwelling unit 46, an upper dwelling unit 58 immediately above the lower unit, and a stairway-hallway unit 50 having a lower landing 50b for access to the lower unit through an entrance door 26, a stairway 50 leading up to the upper unit and an upper landing 50c -for access to the upper unit through an entrance door 28. Dwelling units 48 and 60 and stair unit 52 also form a module, except it is the mirror image of the module of units 46, 50 and 58. The lower landing 52b is on the same floor as the landing 50b, and the upper landing 52c is reached by stairs 52a. The modules of stacks g and h are the same as those of stacks e and f, except the lower dwelling unit of each module in stacks g and h is on the same floor as the upper dwelling unit (e.g. 58 and 60) of a module in stack e or f, since the lower stair landing is reached from the stair unit of a module in stack e or f. The entrance doors 62 of all dwelling units are located to one side of the stairway in the modules in stacks g and h, the difference being an architectural preference which is precluded in the modules of stacks e and f by the through stairs 38 and elevator 40.

The elevator 40 opens at every other floor to the lower landings of the stairs 50 and 52 of each module in stacks e and f. The lower unit of each module in stacks e and f is reached without climbing any stairs. The occupants of the upper units of the modules in stacks e and f and the lower units of stacks g and h walk up one flight of stairs and the occupants of the upper units in stacks g and h walk up two flights. The through stairs 38 comprise the flights 50a of the stair units 50 and flights 38a.

The basic concept of having light and air on two opposite exterior aspects for all units, made possible by openings in the stairway-hallway walls to form a passageway below the upper landing of the stair unit associated with each dwelling unit is applied the same way in the two embodiments of FIGS. 1 to 10.

Figure 11:
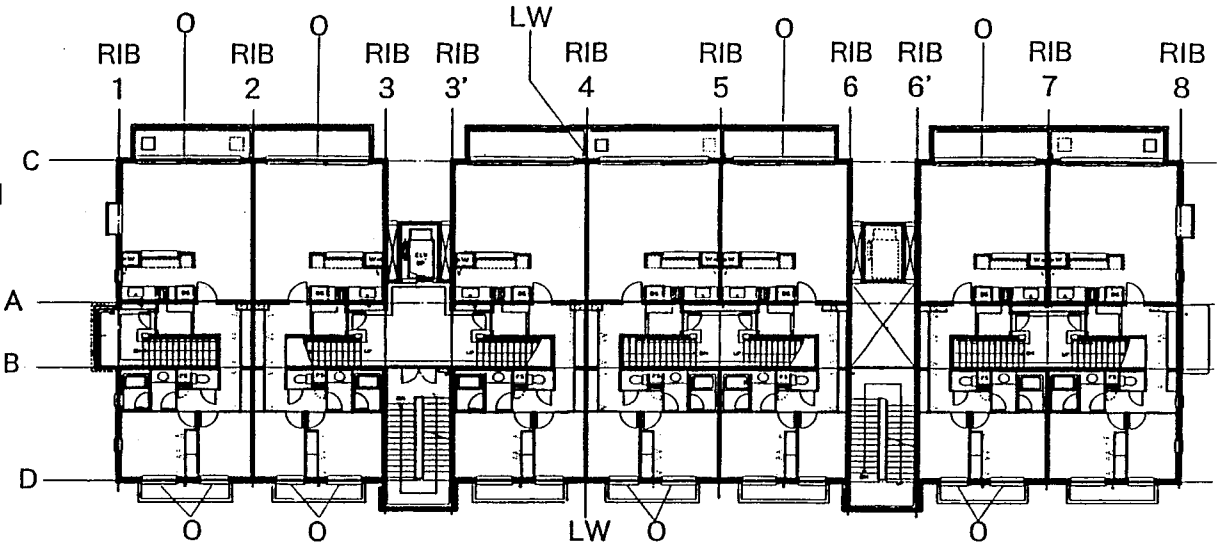
FIG. 11 is a schematic plan view of odd floors of the third embodiment.
Figure 12:
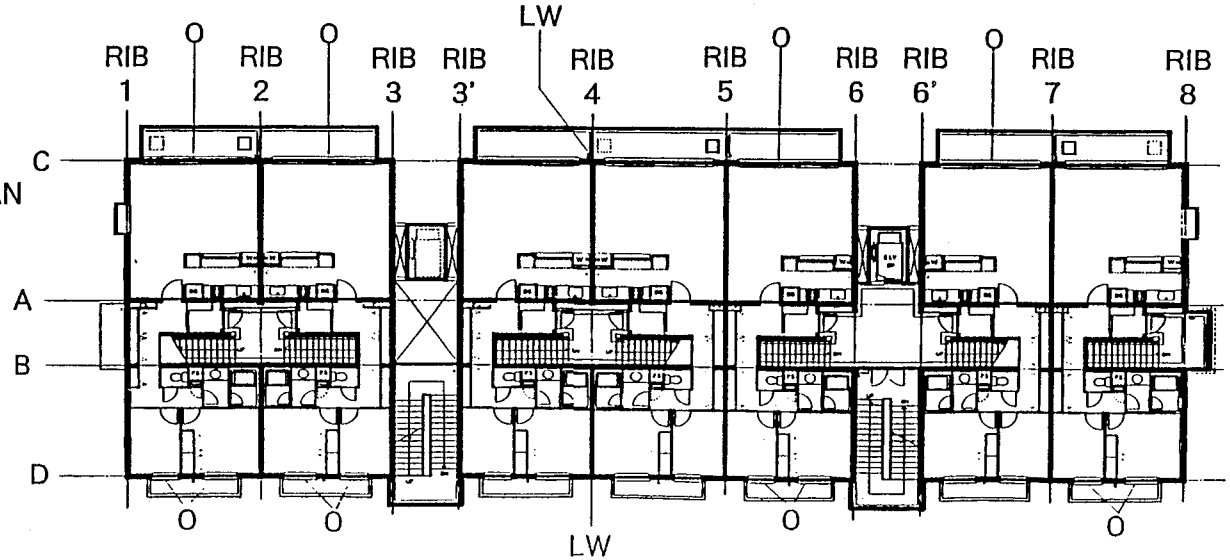
FIG. 12 is a schematic plan view of even floors of the third embodiment.

The embodiments of FIG. 11 to 19 are based on modules that are basically the same as those already described. FIG. 11 is a plan of odd floors. FIG. 12 is a plan of even floors. The building structure comprises two rows of longer walls running along the center of the building and labelled "Spine A" and "Spine B", and the shorter walls transverse to the spines and labelled "Rib 1", "Rib 2", "Rib 3", "Rib 4", etc. These walls are load-bearing, capable of supporting the load generated by earthquakes, and are of vital importance. The longer external walls are labelled "C" and "D".

The elements on each floor of the Spines, Ribs and external walls C and D are vertically aligned with the corresponding elements on all other floors for the full height of the building. Adjacent dwelling units are bounded by these walls, but the openings cut out in Spines A and B are placed symmetrically to each other with respect to the rib between the two adjacent units. Consequently, the layout of entrances, living rooms, bedrooms, and kitchens of these units are also arranged in mirror image to each other with respect to that rib.

The landings of odd floors and those of even floors are arranged in vertically staggered relation floor by floor and thus, the passageways below the landings connecting the living-dining zones and bedroom zones within two adjacent dwelling units are placed symmetrically with respect to the rib between the two units.

Figure 13:
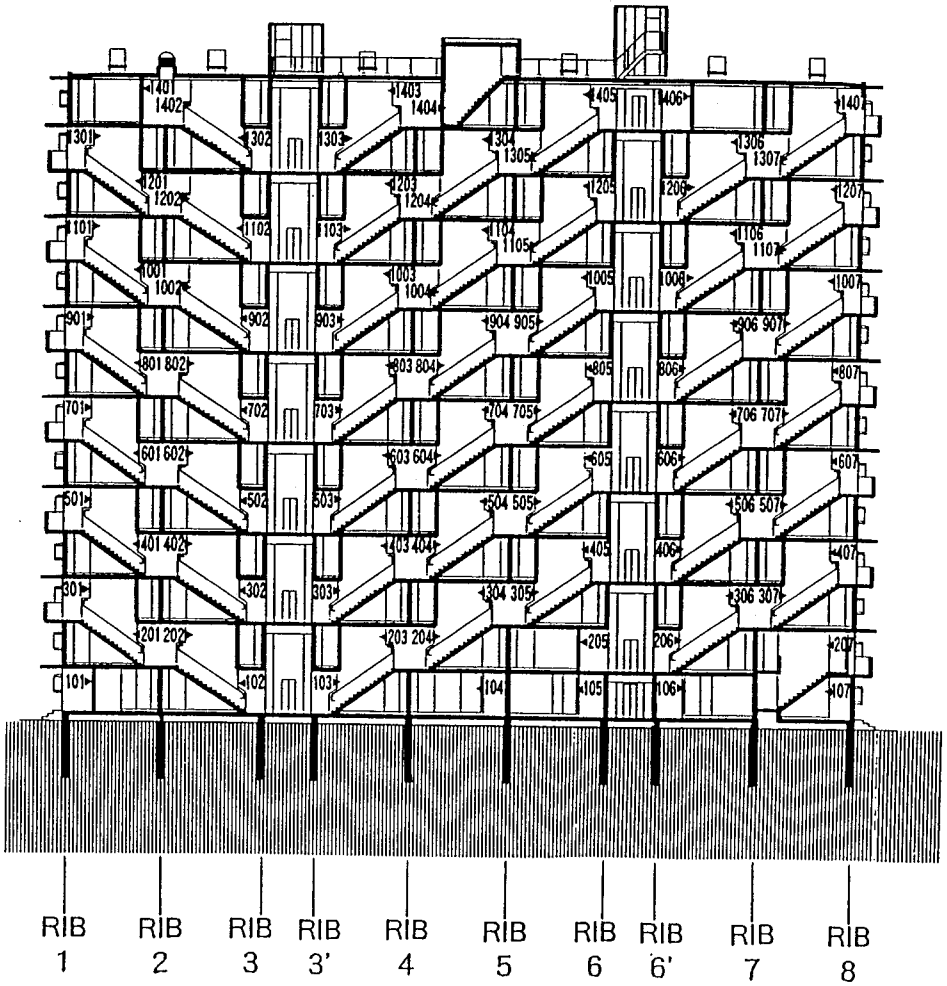
FIG. 13 is a schematic cross-sectional view of the third embodiment taken along the stairway-hallway.

FIG. 13 is the vertical section of the internal stairways and hallways, which run from floor to floor vertically, instead of the usual hallways in conventional apartment houses that run horizontally along each floor.

In this embodiment of the dwelling, people getting off the Shaft A elevator at, for example, the third floor reach dwelling units 302 and 303 on the same floor without climbing stairs, and reach dwelling units 401, 402, 403 and 404 by climbing one flight of stairs. Likewise, people utilizing the Shaft B elevator reach, for example, dwelling units 605 and 606 on the same floor as the lobby, dwelling units 504 and 505 by descending one flight of stairs, and units 706 and 707 by climbing one flight of stairs.

Figure 14:
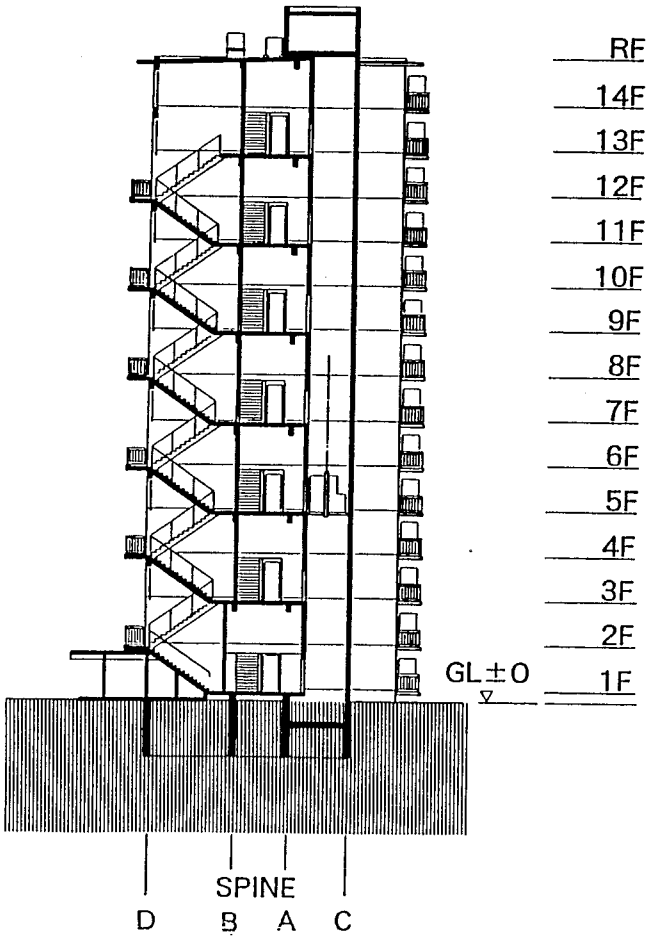
FIG. 14 is a schematic sectional view taken along the through stairway and elevator shaft along the shorter plane of the building.

Among the occupants of dwelling units, such as those shown in gray in FIG. 13 and on a larger scale in FIG. 14, namely, units 303, 403, 504, 506 and 606, one-third (two units) live on the same floor as the elevator lobby, one-third climb one flight of stairs, and one-third descend one flight of stairs. The relationship of the elevator and stairways and the dwelling units shows the typical compositions of the building.

Units 101, 104, 105, 106, 107 and 207 do not integrate into the modular system, but units 101, 104 and 107 can be entered from the outside. Unit 207 is joined to unit 107 by stairs that conform to the stair location in the modules but are accessible only from within unit 107.

The building occupants need not depend on a single through stairway but can escape in two directions in emergencies and reach by stairway-hallways arranged lengthwise of the building other elevator lobbies or balconies facing outside. Also, people can utilize other elevators when one is being serviced.

Figure 15:
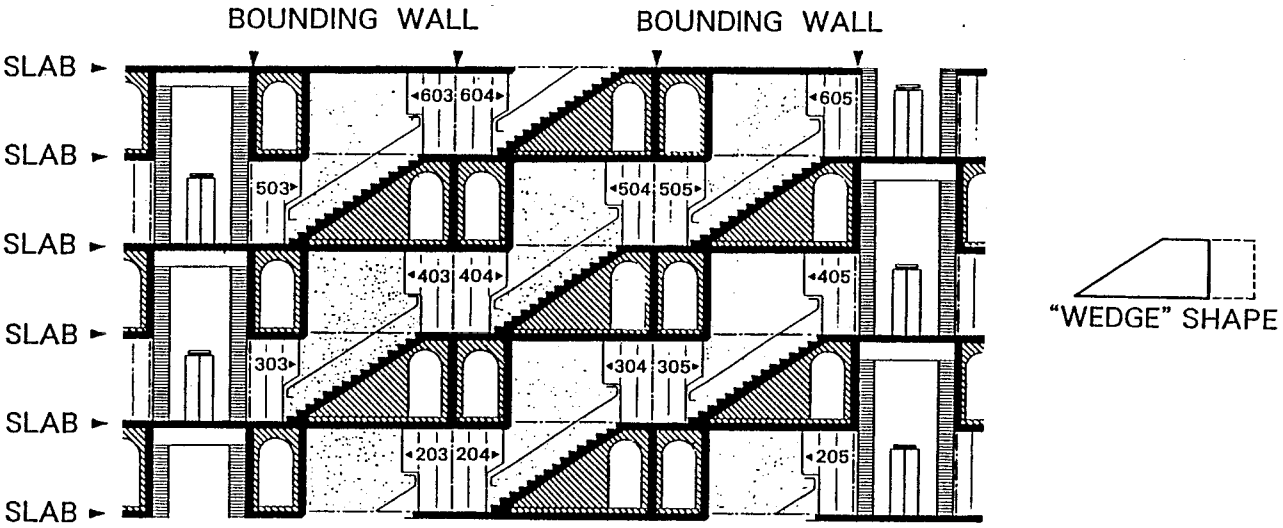
FIG. 15 is a conceptual cross-sectional view of the third embodiment.
Figure 16:
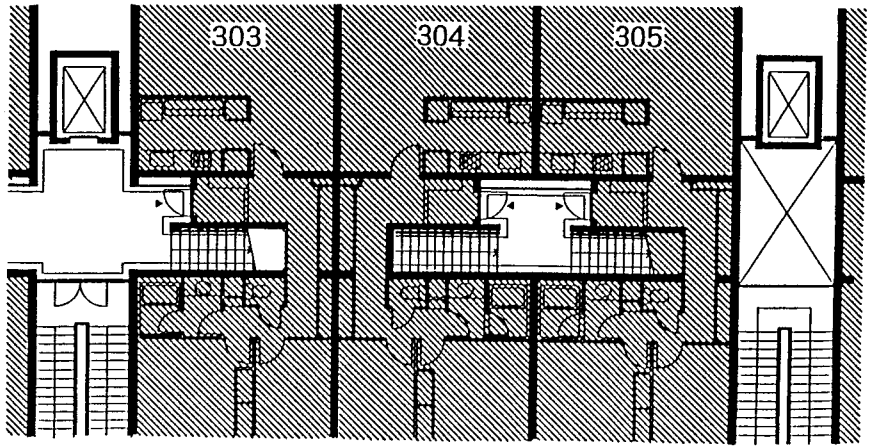
FIG. 16 is a portion of schematic plan of the embodiment of FIG. 12.

FIGS. 15 and 16 show more in detail the relationship of the stairway-hallways, which connect elevator lobbies, and each dwelling unit. The opening cut out in the wedge-shaped space within each dwelling unit shown in gray is the passageway connecting the living room zone and bedroom zone. Different-level crossing of stairways-hallways, which is the common space, and the passageway in the wedge-shaped space within each dwelling unit allows each dwelling unit to have exposure to outside on opposite longer external walls, as well as providing a rational structure design system.

The dwelling, utilizing a reinforced concrete bearing wall system eliminating columns and beams, makes possible structurally rigid, easily constructed and, therefore, economical multi-storied multiple-unit dwellings, which have considerable earthquake resistant strength, even in major earthquake zones such as along the Sierra Nevada mountains in California.

The effectiveness of this invention will be best demonstrated when applied to buildings higher than 5 to 6 stories above ground, and can possibly be realized in buildings as high as 20 stories, even in earthquake zones.

Figure 17:
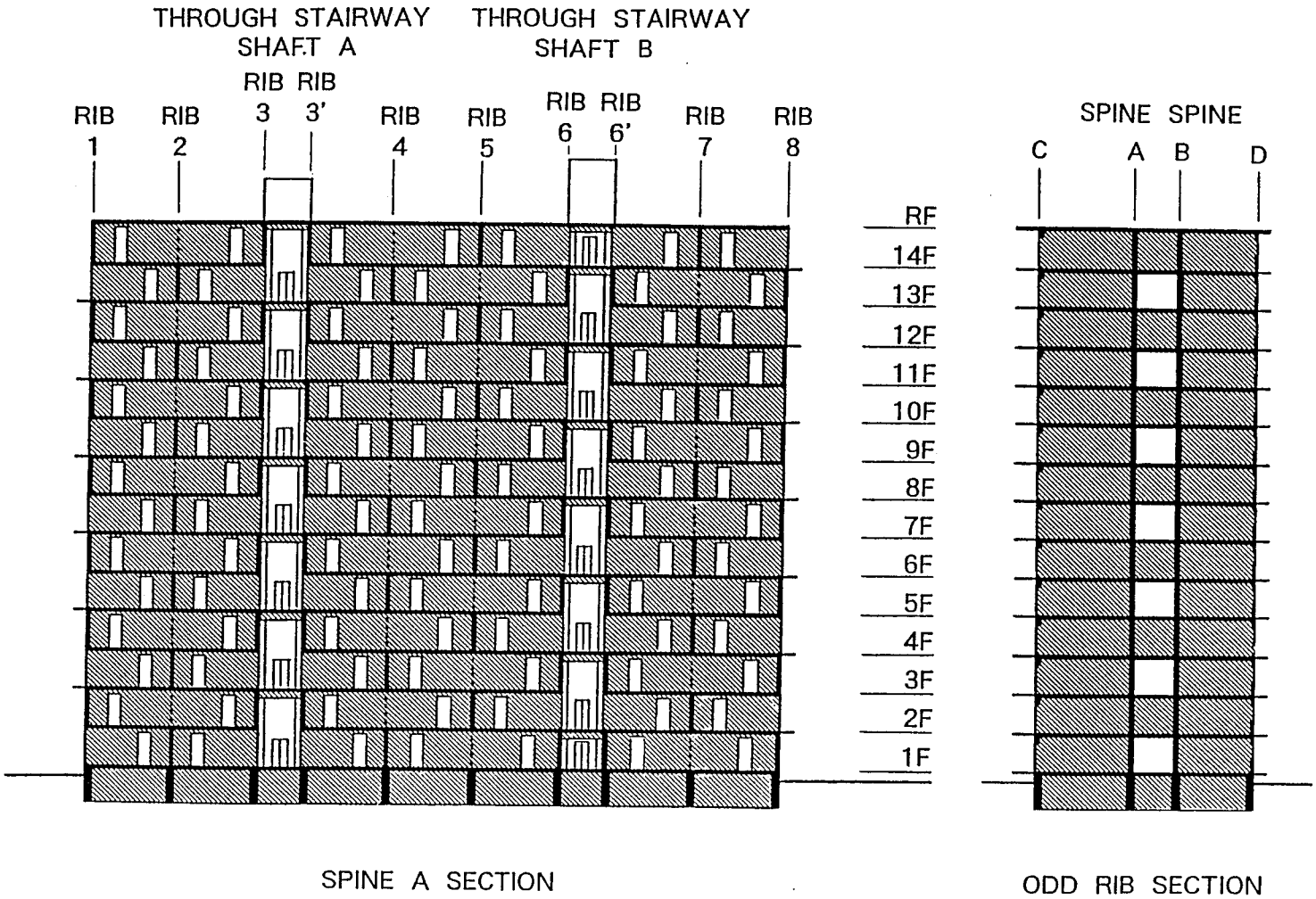
FIG. 17 shows the relationship of the Spine A bearing wall and the odd ribs and openings set out in it.
Figure 18:
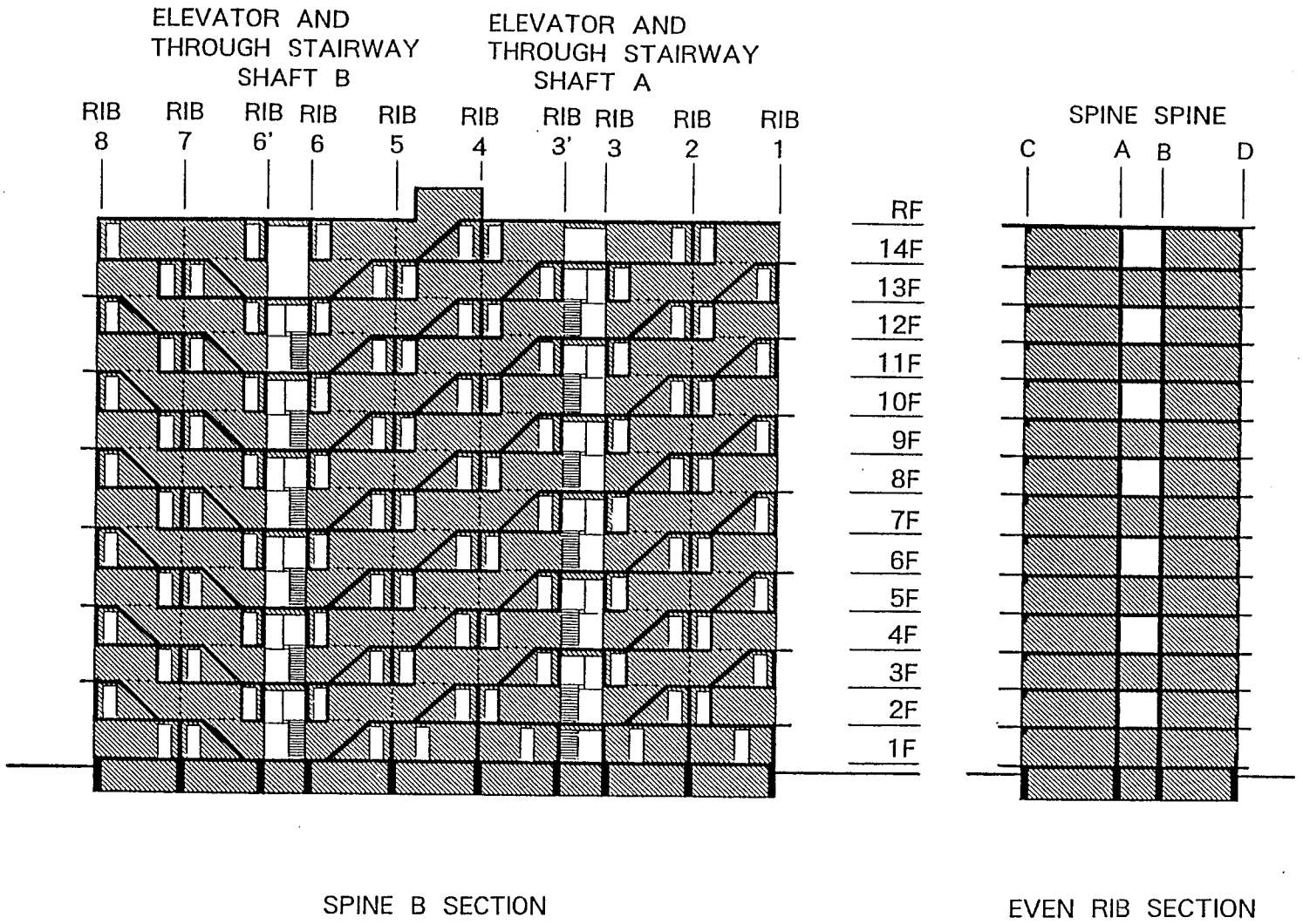
FIG. 18 shows the relationship of the Spine B bearing wall and the even ribs and openings set out in it.

FIGS. 17 and 18 are the cross-sections taken along Spine A and odd rib, and Spine B and even rib, respectively. These sections show the relationship of openings cut out in the wall and the wall itself. Despite the existence of openings shown in white, since the openings are arranged in vertically staggered relation, the spines and ribs shown in gray have rigidity almost identical to one continuous wall without any openings. At the same time, since the walls, i.e., spines and ribs, are effectively arranged, the structure of the entire building has almost absolute anti-earthquake strength, though the number of reinforcing rods, the quantity of concrete, and the number of forms for pouring concrete are remarkably reasonable.

Figure 19:
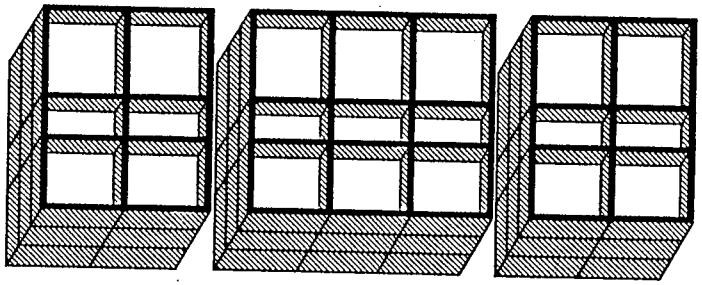
FIG. 19 shows the concept of the Bearing-Wall-Box-Shape Structural System.

FIG. 19 shows the concept of the structural feature of the building, which can be called "Bearing-Wall-Box-Shape-Structure," in which space-bounding plates in the forms of spines, ribs and floor slabs are densely combined to realize a highly rigid box structure.

Figure 20:
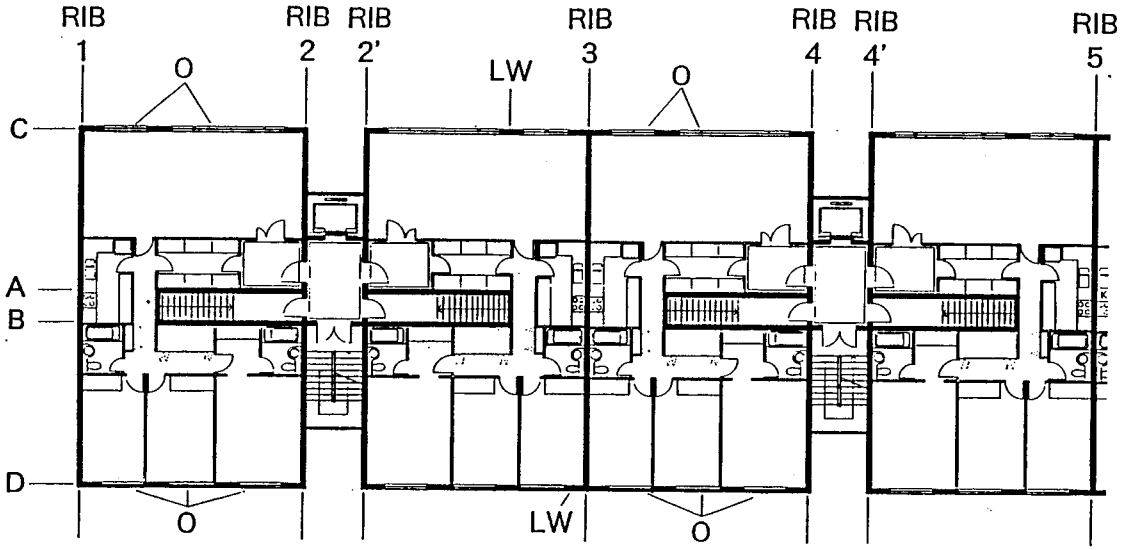
FIG. 20 is a schematic plan view of odd floors of the fourth embodiment.
Figure 21:
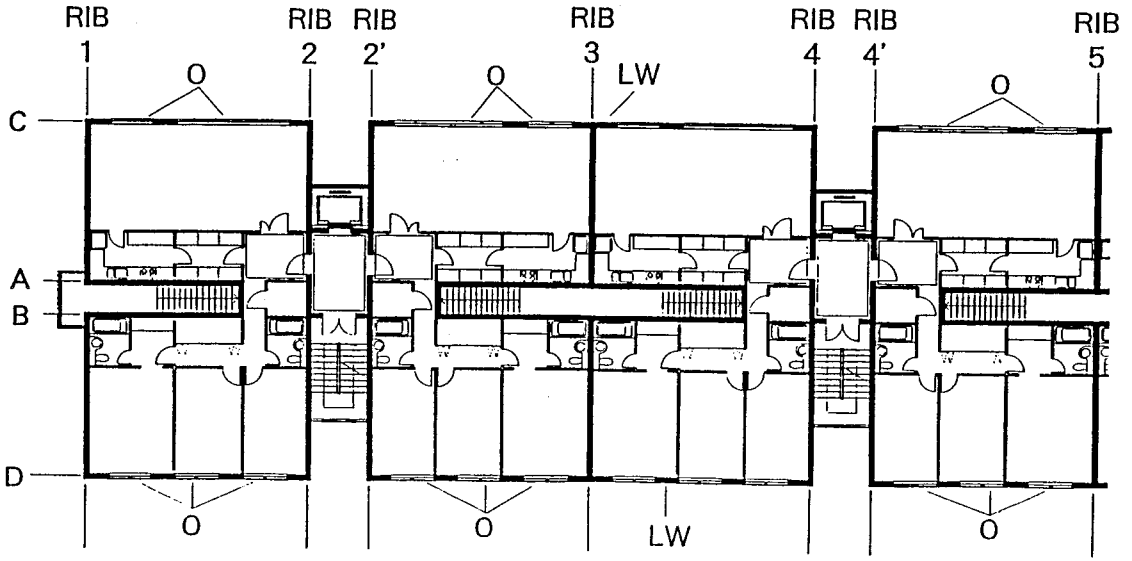
FIG. 21 is a schematic plan view of even floors of the fourth embodiment.
Figure 22:
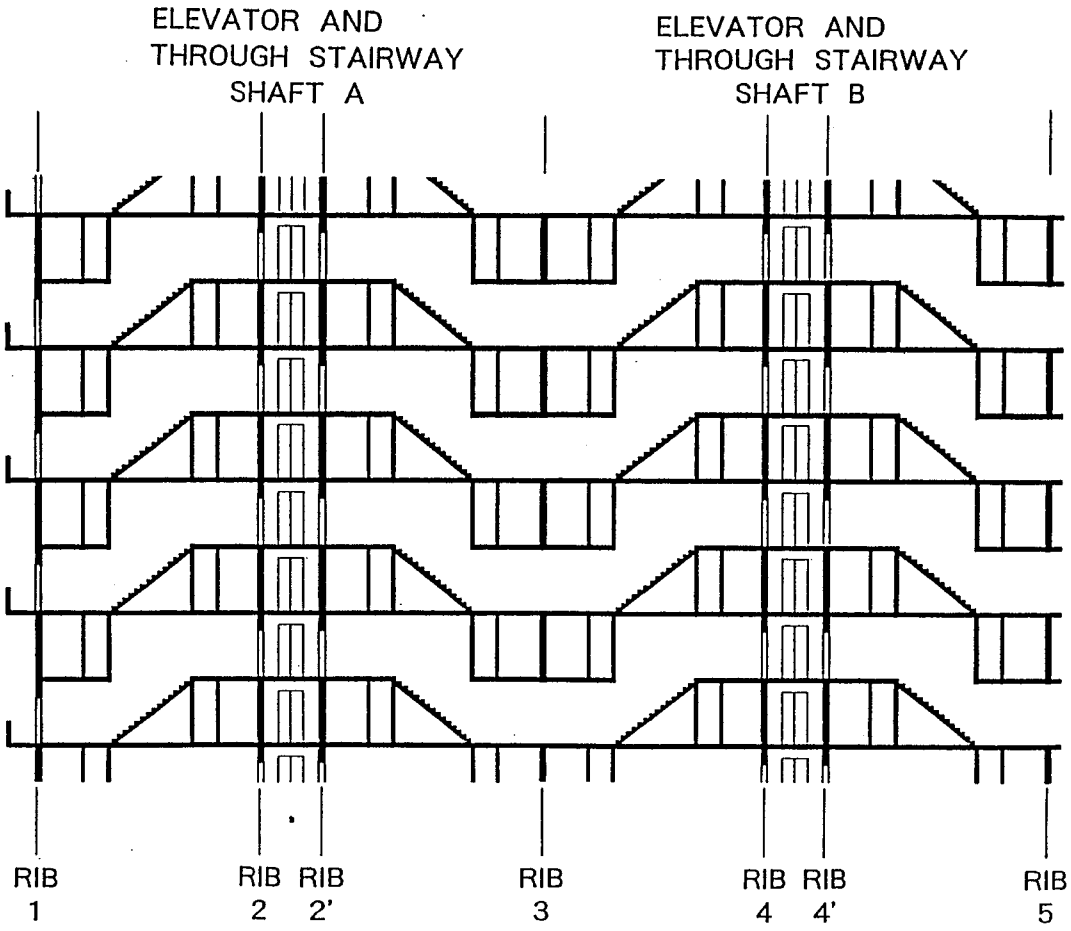
FIG. 22 is a schematic cross-sectional view of the fourth embodiment taken along the stairway-hallway.

FIGS. 20 to 22 show the fourth embodiment, in which all dwelling units can be directly and more comfortably accessed by elevators which open to every floor, thus eliminating the need for climbing or descending one flight of stairs as the third embodiment. In this embodiment, as in the third embodiment, it is possible to escape in two directions in case of emergencies, and occupants can utilize other elevators when one of the elevators is being serviced. As to the other features, such as different-level crossings of stairway-hallways and the passageways within dwelling units, the structural system, and so forth are the same as the third embodiment.

More particularly the embodiment of FIGS. 20 to 22 comprises at least three sections of vertically stacked dwelling units bounded, respectively, by Rib 1 and Rib 2, Rib 2' and Rib 4, Rib 4' and Rib 5, etc. Each end section of the embodiment has one dwelling unit on each floor, and each intermediate section has two dwelling units. The stairs of hallway-stairway units in the end sections and the respective dwelling units of the intermediate section (or sections) descend from the elevator halls on every other floor (the odd-numbered floors). In the case of the units in the end sections the lower landings of the hallway-stairway units open onto exterior balconies for an alternative emergency escape. Access the entire length of the building to other elevators and balconies is provided to all occupants. All occupants reach the hallway-stairways through the elevator halls. Occupants of the even numbered floors use one flight of the through stairs to reach the hallway-stairway accessible from the floor above or below the one they occupy. An obvious variant of the design is to have the stairs ascend rather than descend from the elevator halls, which can be visualized by viewing FIG. 22 upside down.

I claim:

1. A multi-storied multiple-unit dwelling comprising at least three floors, at least four dwelling units on each floor, each of which is exposed to light and air by openings on both of the longer external walls of the dwelling, and a stairway-hallway unit within each dwelling unit bounded by a pair of walls extending lengthwise along generally the center of the building and located in spaced-apart relation to the longer external walls to define living spaces in each dwelling unit between the corresponding stairway-hallway unit and the longer external walls, each stairway-hallway unit having a lower landing on one floor and an upper landing on the next upper floor joined by a stairway, and the walls defining each stairway-hallway unit having openings providing a passageway below the upper landing linking said living spaces of said one unit.

2. A dwelling according to claim 1 wherein the bounding walls of all stairway-hallway units in the dwelling are aligned vertically and horizontally and are load-bearing.

3. A dwelling according to claim 1 wherein the dwelling units are arranged in vertical sections bounded by portions of the longer external walls and by section-bounding walls transverse to and extending between the longer external walls, each section has at least one dwelling unit on each floor, the section-bounding walls of each section are vertically aligned and load-bearing, and the respective bounding walls of all stairway-hallway units in all sections are aligned vertically and horizontally and are load-bearing.

4. A dwelling according to claim 3 wherein there is an end section at each end having only one dwelling unit on each floor, and at least one intermediate section between the end sections having two dwelling units on each floor, wherein the section-bounding walls of all sections of the building are spaced apart to define shaftways for elevators and through stairways, and wherein either the upper or the lower landings of all stairway-hallway units of all sections are adjacent to and accessible from an elevator hall.

5. A dwelling according to claim 1 wherein the dwelling units are arranged in vertical sections bounded by portions of the longer external walls and section-bounding walls transverse to and extending between the longer external walls, wherein in each section there are on each floor at least two adjacent units separated by a common wall, the outermost units of said adjacent units being bounded by section-bounding walls, and wherein the stairway-hallway units are arranged in each section in vertically staggered relation with the upper landing of a stairway-hallway unit on every other floor joined on that floor to the lower landing of another stairway-hallway unit to form a hallway between adjacent units of the section on the same floor.

6. A dwelling according to claim 5 wherein the bounding walls of all stairway-hallway units in the dwelling are aligned vertically and horizontally and are load-bearing.

7. A dwelling according to claim 5 wherein the section-bounding walls and common walls of each section are planar and load-bearing.

8. A dwelling according to claim 5 wherein adjacent sections of the dwelling are spaced-apart and the adjacent section-bounding walls of the adjacent sections define shaftways for through stairways and elevators.

9. A dwelling according to claim 5 wherein at least two adjacent sections o the building abut each other along a common section-bounding wall and wherein a through stairway is provided by the stairway-hallway units serving the dwelling units of one section bounded by the common section-bounding walls and by additional stairways joining the upper landings of each such stairway-hallway unit to the lower landings of the stairway-hallway unit next above them.

10. A multi-storied multiple-unit dwelling having at least three floors, dwelling units arranged in at least two vertical sections bounded by section-bounding walls transverse to and extending between the opposite longer external walls, each section having at least two adjacent dwelling units bounded by a common wall and by portions of the opposite longer external walls for exposure by openings to light and air, and each section having a pair of spaced apart walls transverse to the section-bounding walls, spaced-apart from the longer perimeter walls and defining stairway-hallways that commence at every other floor of the section with a lower landing providing access to the dwelling unit adjacent one section-bounding wall and ascend by two flights of stairs to the next two floors with an intermediate landing for access to two units on the floor above the lower landing and an upper landing for access to a unit on the second floor above the lower landing, each dwelling unit below one accessed from a stairway landing having a passageway afforded by openings in the walls defining the stairway-hallways.

11. A dwelling according to claim 10 wherein there are at least three sections including an intermediate section that has three dwelling units on each floor and two end sections that have two dwelling units on each floor, the sections are spaced apart from each other by shaftways, elevators and through stairs are located in the shaftways between the sections, and the stairway-hallways of the intermediate section ascend from a lower landing on every other floor adjacent one section-bounding wall by three flights of stairs to an upper landing adjacent the other section-bounding wall with intermediate landings on the second and third floors above the floor of the lower landing for access to two adjacent dwelling units from each of the intermediate landings.

12. A dwelling according to claim 10 wherein the adjacent dwelling units of each section are bounded by straight common dividing walls extending transversely between the longer opposite perimeter walls, the common walls are vertically and horizontally aligned, the bounding walls of stairway-hallway units in the dwelling are aligned vertically and horizontally, and the common walls, section-bounding walls and the walls defining the stairway-hallways are load-bearing.

* * * * *